US007080763B2

(12) United States Patent
Allen et al.

(10) Patent No.: US 7,080,763 B2
(45) Date of Patent: Jul. 25, 2006

(54) CARRYING STRAP FOR NOTEBOOK COMPUTER

(75) Inventors: Jonathan Michael Allen, Rochester, MN (US); Mark James Jeanson, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 314 days.

(21) Appl. No.: 10/632,159

(22) Filed: Jul. 31, 2003

(65) Prior Publication Data

US 2005/0023311 A1 Feb. 3, 2005

(51) Int. Cl.
*A45F 3/14* (2006.01)

(52) U.S. Cl. ..... 224/257; 206/320

(58) Field of Classification Search ..... 224/257, 224/600–607, 264; 206/320; 361/683, 679, 361/724

See application file for complete search history.

(56) References Cited

U.S. PATENT DOCUMENTS

| | | | | |
|---|---|---|---|---|
| 4,733,840 | A * | 3/1988 | D'Amore | 248/205.3 |
| 4,978,044 | A * | 12/1990 | Silver | 224/601 |
| 5,361,610 | A * | 11/1994 | Sanders | 70/14 |
| 5,673,573 | A * | 10/1997 | Green | 70/14 |
| 6,015,132 | A * | 1/2000 | Belle | 248/683 |
| 6,163,450 | A * | 12/2000 | Kim | 361/679 |
| 6,726,071 | B1 * | 4/2004 | Baseflug et al. | 224/258 |
| 6,735,990 | B1 * | 5/2004 | Murray et al. | 70/58 |
| 6,742,366 | B1 * | 6/2004 | Lai | 70/58 |
| 2002/0044406 | A1 * | 4/2002 | Shimoda et al. | 361/679 |
| 2003/0075578 | A1 * | 4/2003 | Abelow | 224/666 |

FOREIGN PATENT DOCUMENTS

| | | | | |
|---|---|---|---|---|
| JP | 2002-149264 | * | 5/2002 | 224/257 |
| JP | 2002-306228 | * | 10/2002 | 224/257 |

* cited by examiner

*Primary Examiner*—Lien M. Ngo
(74) *Attorney, Agent, or Firm*—Robert W. Lahtinen

(57) ABSTRACT

A shoulder strap for carrying a notebook computer is formed as an elongated member with a locking mechanism at a first end which attaches to the lock slot of the computer and a loop at the opposite end. By passing the strap through the loop, the opposite end portion of the strap is positioned around the computer adjacent the side opposite the side which includes the lock slot. With the first end of the strap secured to the computer by securing the locking mechanism at the computer lock slot, the intermediate portion of the strap extends over the users shoulder to enable transport of the computer. By forming the strap using a plastic coated steel cable, the shoulder strap may be used for both carrying the computer and as a security cable for securing the computer when unattended. The shoulder strap surfaces that engage the user's shoulder and surround and engage the notebook computer are formed of non-adhesive, non-slip material. In an alternate embodiment, to more positively secure the strap portion surrounding the computer, hook and loop tape is applied to both the strap portion engaging the computer and the computer side over which the assembled strap passes, so that the strap can be prevented from slipping off the computer when assembled for transport.

9 Claims, 3 Drawing Sheets

CARRYING STRAP FOR NOTEBOOK COMPUTER

FIELD OF THE INVENTION

The present invention pertains to computers and more particularly to a carrying strap for transporting a notebook computer or similar apparatus that includes a lock slot.

BACKGROUND OF THE INVENTION

When a notebook computer is not in use it is common practice to place the device in a carrying case for safety and transport. This enables the equipment to be secured and protected during travel or storage and affords availability when required. However, notebook computers have become regularly used tools within an office environment and it has been found useful or even necessary to move the computer from place to place as it accompanies the user to meetings. When moving from place to place during meeting attendance at various successive sites, it is inconvenient to stow the computer in a carrying case and remove it frequently for use. With the computer in use, the carrying case becomes an awkward article to stow in a meeting environment. This inconvenience causes users to carry the computer without protection along with documents and other meeting materials.

When using a notebook computer during frequent, intermittent periods at various locations it is desirable to protect the computer using a simple device that will reduce the possibility that the computer will be dropped or otherwise accidentally damaged. Such a device should be simple and not add structure that would be awkward to use and accommodate when the computer is in use causing the device to be cast aside as inconvenient.

SUMMARY OF THE INVENTION

The shoulder strap of the present invention provides a simple device for safely transporting a notebook computer. The shoulder strap is secured at one end by attaching to the computer lock slot and at the other end by surrounding the computer as the strap passes around the computer and through a terminal loop at the strap end enabling it to be snugly secured. Means are also used, such as a non-adhesive, non-slip material along the surfaces of the strap that engage the users shoulder during transport and support and surround the notebook computer, the surfaces should provide resistance to relative motion akin to that provided by the rubber like sheets used to prevent throw rugs from sliding from a desired location when subjected to foot traffic. The notebook computer may thus be moved from place to place in a convenient, hands free mode.

Many notebook computer users employ a cable lock to secure the computer when unattended. The device comprises a locking mechanism which attaches at the computer lock slot. From the locking mechanism, a plastic coated steel cable extends, which is nominally about six and a half feet in length, and terminates in a loop to enable the computer to be secured by passing the cable about a substantial or large stationary object and through the terminal loop to secure the computer to such object. By modifying the cable to include enlarged width portions which pass over the users shoulder and at the location of support under the computer, a single device may serve to support the computer during transport and secure the computer when left unattended.

DETAILED DESCRIPTION

Figure 1:
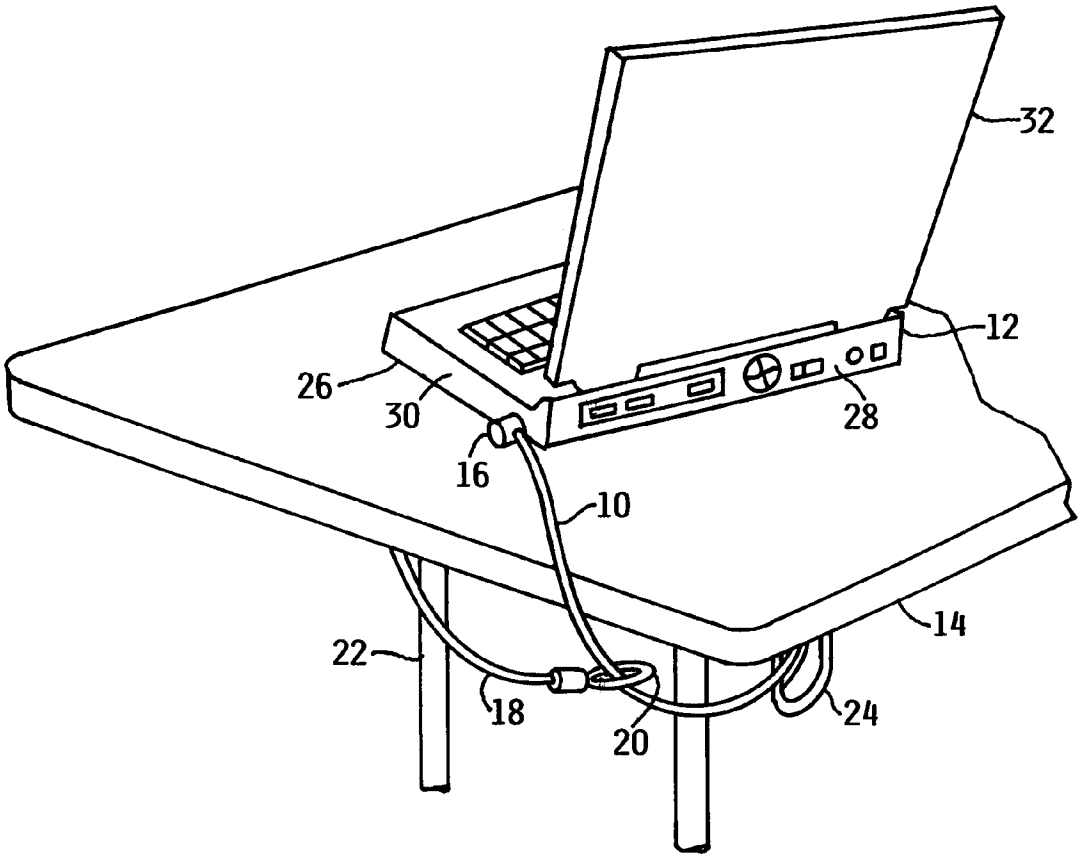
FIG. 1 (PRIOR ART)
FIG. 1 shows a typical security cable used to secure a notebook computer to a computer table.

FIG. 1 shows a typical security cable 10 used to secure a notebook computer 12 to a computer table 14. The security cable 10 comprises a locking mechanism 16 from which extends a plastic coated steel cable 18 which terminates at the far end in a loop 20. The locking mechanism 16 may be either key operated or a combination locking device which has a portion that projects into a lock slot in a computer side wall 30 and is expanded or rotated to secure the locking mechanism to the computer side wall. The cable 10 is typically about six and a half feet in length and is shown secured to the computer table 14 by passing the cable around the table trestle leg portion 22, through the table rear wall cable opening 24 and through the cable loop 20. A typical notebook computer 12, shown in FIG. 1, includes a base member 26 which contains the central processor unit (cpu) and the principal auxiliary and peripheral elements of the computer. Further, the base member 26 has four sides at which connectors are presented and through which internal peripheral devices are accessed. The rear wall 28 includes serial and parallel connectors, a fan opening, and connectors for such auxiliaries as a mouse or an external keyboard. The front and side walls (side wall 30 being visible) include media access openings to disk drives and one or more openings through which PCMCIA devices may be inserted and connected.

Figure 2:
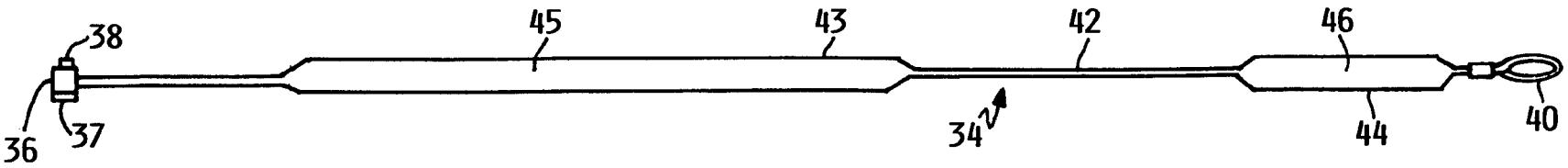
FIG. 2 illustrates the shoulder strap of the present invention.

The shoulder strap 34 of the present invention is illustrated extending linearly for its full length in FIG. 2. At one end is the locking mechanism 36, which is accessed by a key at one side 37 and has at the opposite side a projection 38 that includes a movable or rotatable portion that may be actuated to secure the lock mechanism, with the projection 38 extending through the lock slot in the computer side wall. A steel cable extends from the locking mechanism 36 and terminates in a loop 40 at the distal end. The cable is coated with a plastic material 42 which includes increased width, flat portions 43 and 44 between the ends. The strap increased width surfaces 45 and 46 are fabricated using a non-adhesive, non-slip material that resists relative motion between itself and a contacting surface. When the strap is in use, the strap surface 45 engages the user's shoulder and the surface 46 engages the notebook computer surface when secured as illustrated in FIG. 3.

Figure 3:
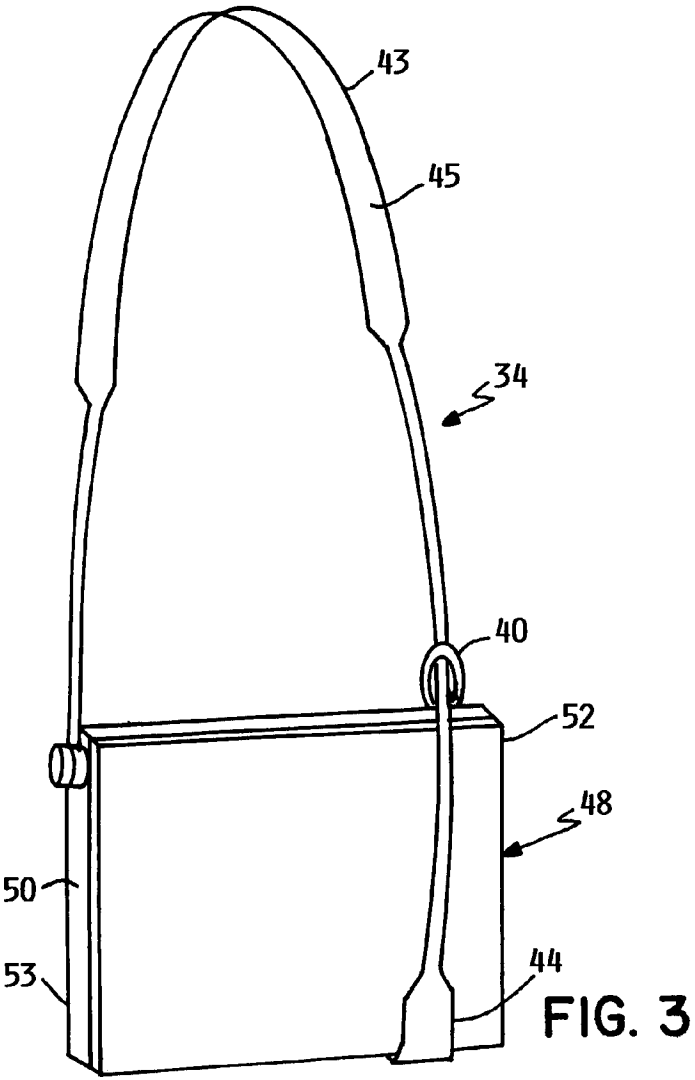
FIG. 3 shows the shoulder strap of FIG. 2 attached to a notebook computer with the security lock at one end attached to the computer lock slot and the other terminal end portion surrounding the computer.

As viewed in FIG. 3, the shoulder strap 34 in use has the locking mechanism 36 secured to a notebook computer 48 at the lock slot in the base member side wall 50. With the computer closed and the cover 52 pivoted against the base member 53, the strap 34 surrounds the computer 48 and passes through the loop 40 enabling the strap to be brought snugly about the computer with the flat, increased width portion 44 supporting the base member front wall adjacent the side wall opposite side wall 50. The flat, increased width portion 43 provides an extended surface that extends over the wearers shoulder during transport to distribute the weight of the computer for the users comfort.

The use of a computer lock slot is believed to be common to all notebook computers, but varies as to the location on the device. Some notebook computers include a lock slot in the right side wall of the base unit (as viewed by a user of the computer) adjacent the rear wall as shown in FIG. 1. Other notebook computers include the lock slot in the left side wall adjacent the rear wall as illustrated in FIG. 3 with the shoulder strap of the present invention attached. The lock slot is also commonly found in the notebook computer rear wall adjacent one of the side walls. The shoulder strap of this invention can be utilized irrespective of which of the above locations is present on the computer.

Figure 4:
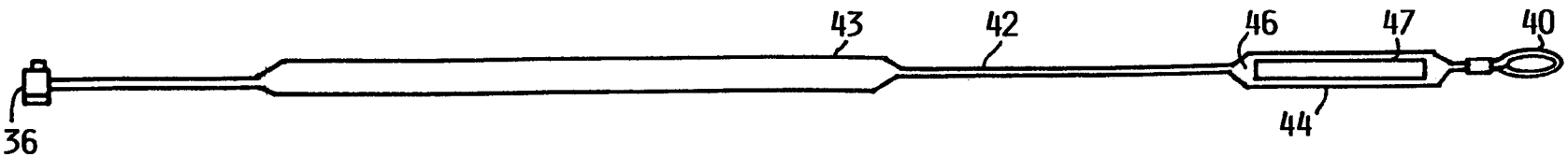
FIG. 4 is similar to FIG. 2, showing a second embodiment of the shoulder strap of the present invention.

FIG. 4 shows a second embodiment of the shoulder strap of the present invention. This strap is similar to the embodiment of FIG. 2 including a lock mechanism 36 for securing the strap to the notebook computer at the lock slot, a plastic coated cable 42, increased width porions 43 and 44 and a loop 40 at the distal end. In this embodiment, a strip of hook and loop tape 47 extends along and is affixed to the surface 46.

Figure 5:
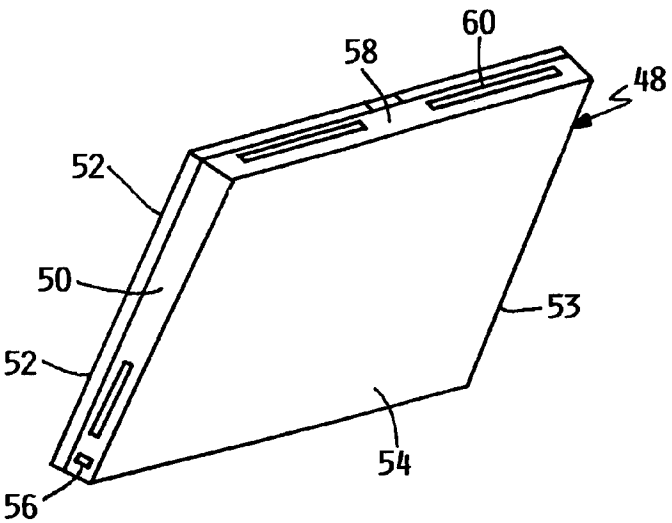
FIG. 5 shows the computer of FIG. 3 rotated to expose the bottom surface and the edge surfaces that include the lock slot and the attached hook or loop strip that implements the second embodiment of the invention illustrated in FIG. 4 to retain the shoulder strap when the latter has the end portion surrounding the computer.

FIG. 5 shows the notebook computer 48 of FIG. 3 rotated to expose the bottom surface 54 of the base member 53, which is obscured in the view of FIG. 3. The lock slot 56 is visible in the side wall 50 of base member 53. Using the carrying strap embodiment of FIG. 4, the front wall surface 58 of base member 53 has adhered thereto a strip 60 of hook and loop tape material. The adhered strip 60 on the computer base member 53 is either hook or loop material and the affixed strip 47 on the shoulder strap increased width portion 44 (seen in FIG. 4) is the other of hook and loop material so that when the shoulder strap 34 is assembled to the computer 48 as shown in FIG. 3, the strips 47 and 60 intersect and engage to resist relative motion of the strap portion 44 with respect to the surrounded the notebook computer 48. Thus the strap end surrounding the computer, even if loosely and casually assembled for transport, should not fail to support the computer as it is carried from place to place. The embodiment of FIG. 4 affords more positive temporary attachment of the strap to the notebook computer, but does so by requiring that the hook and loop tape strip be attached to an unused surface of the computer base member 53, which is less convenient and makes the transfer of the strap to another device more cumbersome.

The shoulder strap of the present invention could be formed of any material such as a continuous width belt with a loop or other means at the distal end to effect attachment about the computer. However, by using a steel cable connected to the locking mechanism at one end and terminating in a loop at the opposite end, the shoulder strap can serve both to transport the computer when assembled as seen in FIG. 3 and can be assembled to connect the computer to some large or stationary object (as is the security cable of FIG. 1) to perform the security function. If the user employs a security cable, then the shoulder strap, as shown herein, could be adopted to perform both functions without having to accommodate a second auxiliary device. The convenience of a single device may induce a user to adopt its use for both casual transport and security whereas both functions may be foregone if it were necessary to use a separate apparatus for each.

While the invention has been shown and described with reference to preferred embodiments thereof, it will be understood by those skilled in the art that various changes in form and details may be made therein without departing from the spirit and scope of the invention.

What is claimed is:

1. A carrying strap for transporting a notebook computer, which includes a base unit with side walls which include a lock slot and a pivoted cover that can be pivoted to a closed position against the base unit comprising an elongated strap member;

a security lock at one end of said strap member which is releasably engageable with said computer lock slot;

a loop formed at the other terminal end of said strap member;

said strap in a computer transporting position having said security lock engaged in said lock slot and at the said other terminal end said strap member passed though said loop and positioned to surround said notebook computer when said cover is in said closed position with respect to said base unit; and means for resisting movement of said strap member from said position in surrounding relationship with respect to said notebook computer.

2. The notebook computer carrying strap of claim 1 wherein said strap member comprises a metal cable connected at one end to said security lock and terminating at the end opposite said one end in said loop.

3. The notebook computer carrying strap of claim 2 wherein said strap member is a shoulder strap which further comprises a coating material surrounding said metal cable with increased width portions through at least the portions of the strap length that engage a users shoulder and support the notebook computer with the strap portion positioned to surround the computer.

4. The notebook computer carrying strap of claim 3 wherein said means for resisting movement comprises a non-slip material at the surface of said increased width portion which engages and supports the notebook computer when said strap is positioned to surround the notebook computer.

5. The notebook computer carrying strap of claim 4 further comprising a non-slip material at the increased width portion surface which engages the users shoulder as the computer is being transported.

6. The notebook computer carrying strap of claim 3 wherein said means for resisting movement comprises strips of hook and loop tape, one strip affixed to the strap portion that passes under the computer when said strap is assembled about the computer and the other strip adhered to the surface of the computer where such surface is engaged by the surrounding strap portion which presents said one strip when assembled to enable transport of the computer.

7. The notebook computer carrying strap of claim 6 wherein said strap increased width portions are formed of the material used to surround and coat said metal cable.

8. A shoulder strap for transporting a portable device which includes a lock slot comprising:

a lock member which may be releasably connected to said portable device at said lock slot and an elongated strap connected to and extending from said lock member and terminating at the distal end in a loop;

said shoulder strap having a portable device transporting position wherein said lock member is attached to said portable device at said lock slot and the distal end portion is passed through said loop and surrounds said portable device;

first means carried by the portion of said strap which surrounds said portable device in said portable device transporting position; and second means presented by said portable device which cooperates with said first means to secure said strap in said portable device surrounding transporting position.

9. The shoulder strap of claim 8 further comprising a metal cable extending through said elongated strap which attaches to said lock member at one end and passes through said loop at said distal end, whereby said shoulder strap may function either to transport said portable device or serve as a security cable when said portable device might be unattended.

* * * * *